US006286792B1

(12) United States Patent
Best

(10) Patent No.: US 6,286,792 B1
(45) Date of Patent: Sep. 11, 2001

(54) SUPPORT FRAME FOR FLEXIBLE BULK CONTAINERS

(76) Inventor: Deryn Richard Warren Best, 4 Foxfields Drive, Amesbury Lane, Oakwood, Derby, DE21 2ND (GB)

( * ) Notice: Subject to any disclaimer, the term of this patent is extended or adjusted under 35 U.S.C. 154(b) by 0 days.

(21) Appl. No.: 09/287,080

(22) Filed: Apr. 6, 1999

(30) Foreign Application Priority Data

Apr. 8, 1998 (GB) ..... 9807419

(51) Int. Cl.[7] ..... B65D 19/00

(52) U.S. Cl. ..... 248/97; 248/346.03; 108/53.1; 108/55.1; 217/434; 206/386

(58) Field of Search ..... 348/97, 127, 146, 348/147, 151, 99, 346.02, 346.03; 217/36, 43 A; 108/51.11, 53.1, 52.1, 55.1; 206/386

(56) References Cited

U.S. PATENT DOCUMENTS

| | | | | |
|---|---|---|---|---|
| 2,579,655 | * | 12/1951 | Donald | 108/53.5 |
| 2,579,685 | * | 12/1951 | Loose | 220/6 |
| 3,080,992 | * | 3/1963 | Dedmon | 217/48 |
| 3,405,665 | * | 10/1968 | Slonim | 108/55.1 |
| 3,499,398 | * | 3/1970 | Murray | 108/53.5 |
| 4,221,296 | * | 9/1980 | Fell et al. | 206/600 |
| 4,266,678 | | 5/1981 | Daly . | |
| 4,673,092 | * | 6/1987 | Lamson et al. | 211/188 |
| 4,703,702 | | 11/1987 | Speicher . | |
| 4,773,547 | * | 9/1988 | Bell | 211/194 |
| 5,228,821 | * | 7/1993 | Gleffe et al. | 414/403 |
| 5,507,237 | * | 4/1996 | Barrow et al. | 108/55.1 |
| 5,609,111 | * | 3/1997 | Hasegawa et al. | 108/55.1 |
| 6,076,690 | * | 6/2000 | Hemmerly | 217/43 R |

FOREIGN PATENT DOCUMENTS

| | | |
|---|---|---|
| 0109191 | 5/1984 | (EP) . |
| 0373506 | 6/1990 | (EP) . |
| 0393369 | 10/1990 | (EP) . |
| 2487300 | 1/1982 | (FR) . |
| 896733 | 5/1962 | (GB) . |

* cited by examiner

*Primary Examiner*—Anita M. King
(74) *Attorney, Agent, or Firm*—Renner, Kenner, Greive, Bobak, Taylor & Weber

(57) ABSTRACT

A frame for supporting a substantially non-rigid container, the frame comprising:

(a) a base-component (10) having at least two frame-members (11, 12) and at least two cross-members (13, 14);

(b) a pair of side-components (20, 30) attached to opposite sides of the base-component (a) and extending upwardly therefrom, each side-component (b) having at least two frame-members (21, 22; 31, 32) and at least one cross-member (23, 33);

(c) a top-component (40) adapted to engage the side-components (b) whereby the base-component (a), the side-components (b) and the top-component (c) define between them a substantially parallelepiped cavity (C) to receive the container, the top-component (c) having at least two frame-members (41, 42) and at least two cross-members (43, 44), together with one or more support-members (45, 46, 47, 48) to engage the container, said top-component (c) being adapted to be lifted free of the side-components (b);

in which each frame-member (41, 42) of the top-component (c) is of substantially U-shaped transverse cross-section each frame-member (21, 22; 31, 32) of a side-component (b) being received within the "U".

15 Claims, 2 Drawing Sheets

SUPPORT FRAME FOR FLEXIBLE BULK CONTAINERS

TECHNICAL FIELD

This invention relates to a frame for supporting a substantially non-rigid container. The present invention will be described herein with particular reference to a frame for supporting a container of the type known as a "flexible intermediate bulk container" (or F.I.B.C. bag) but it is not to be construed as being limited thereto.

BACKGROUND OF THE INVENTION

F.I.B.C. bags are generally used to contain, for storage and/or transportation, building materials, for example cement, sand, aggregate and the like. The bags are generally made from a fabric or a fabric-like material and are of substantially parallelepiped configuration with an open "top". One or more lifting-handles are provided on the periphery of the open "top" of each bag.

The material of which the bag is made, together with the tendency of the contents to behave as a fluid, has been found to contribute to damage of the bag and/or to spillage of the contents. Moreover, if F.I.B.C. bags are to be stored on conventional pallets, it has not hitherto proved possible to stack such loaded pallets beyond "two high".

The specification of South African Patent 83/7654 describes a frame comprising a base-component, a pair of side-components and a separable top-component from which a bag, such as a F.I.B.C. bag, can be suspended.

The Applicant has devised an improved frame in which at least a part of the top-component is provided with means for the positive location of the top-component with the side-component, said location being achieved by the use of a section of defined shape and configuration.

BRIEF SUMMARY OF THE INVENTION

Accordingly, the present invention provides a frame for supporting a substantially non-rigid container, the frame comprising:

(a) a base-component consisting essentially of at least two frame-members maintained apart and substantially parallel to each other by means of at least two cross-members;

(b) a pair of side-components adapted to be attached to opposite sides of the base-component (a) and to extend upwardly therefrom in a plane substantially perpendicular to the plane of the base-component (a), each said side-component (b) consisting essentially of at least two frame-members maintained apart and substantially parallel to each other by means of at least one cross-member;

(c) a top-component adapted to operatively engage the side-components (b) and to be substantially parallel to the base-component (a), whereby the base-component (a), the side-components (b) and the top-component (c) define between them a substantially parallelepiped cavity to receive the container, the top-component (c) consisting essentially of at least two frame-members maintained apart and substantially parallel to each other by means of at least two cross-members, together with one or more support-members to engage and support the container, said top-component (c) being adapted to be lifted free of the side-components (b);

in which each frame-member of the top-component (c) is of substantially U-shaped transverse cross-section, whereby, when the top-component (c) and side-component (b) are brought into operative engagement, each frame-member of a side-component (b) is received within the "U" of a frame-member of the top-component (c).

Preferably, each arm of the "U" is at an obtuse internal angle to the base of the "U". Most suitably, the internal angle of the "U" is about 104°–110°.

Preferably, the cross-members of the base-component (a) are substantially at right angles to the frame-members. Most preferably, the cross-members are of hollow (e.g. rectangular) transverse section and adapted to receive lifting-means, such as the tines of a fork-lift truck. Suitably, the frame-members may be of generally L-shaped section.

The frame-members of the side-components (b) may also be of generally L-shaped section and each cross-member may suitably be of hollow (e.g. rectangular) section. One or more further support-members (or "stretchers") may be provided on each side-component (b) to enhance strength and impact-resistance. Such "stretchers" are conveniently attached (e.g. by welding) to the center of each frame-member, and to the center of the respective cross-member, of each side-component (b).

Preferably, a foot or similar support is attached to the lowermost end of each frame-member of the side-component (b), to enhance the stability of the frame.

Preferably, the cross-members of the top-component (c) are substantially at right angles to the frame-members. Most preferably, the cross-members are of hollow (e.g. rectangular) transverse section and adapted to receive lifting-means, such as the tines of a fork-lift truck.

Each generally U-shaped frame-member of the top-component (c) may further be provided with one or more reinforcing-members or "butterflies", each "butterfly" being received within and attached to the inner surfaces of the "U". The "butterflies" serve the purposes of maintaining the required configuration of the U-shaped frame-member and of minimizing abrasion caused by the frame-members of the side-components (b) on the frame-members of the top-component (c). Preferably, one "butterfly" is located at each opposite end of a frame-member of the top-component (c).

The support-members which receive and engage the container on the top-component (c) may suitably comprise hook-like members. Preferably, one such hook-like member is provided at each corner of the top-component (c).

In a preferred embodiment of the present invention, each hook-like member has a substantially triangular portion adapted to engage a frame-member of the top-component (c), the triangular portion being supported on the top-component with the hook-like member extending therefrom into the cavity which receives the container.

The top-component (c) may further be provided with one or more location-members (e.g. lugs) to engage and/or locate the side-components (b) of a further frame according to the present invention, whereby two or more frames can be stacked one above the other.

Preferably, the location-members engage the feet provided on the side-components (b).

It has been found that at least five frames according to the present invention can be stacked one above the other without adversely affecting the stability of such an assembly.

The substantially non-rigid container may be made of a fabric or fabric-like material and may consist of a flexible bulk container of the type used to contain building materials. Such a bag may be provided with a "handle" at each corner and in the practice of the present invention each "handle" is engaged on one of the support-members of the top-component (c).

DESCRIPTION OF DRAWINGS

The present invention will be illustrated, merely by way of example, in the following description and with reference to the accompanying drawings.

In the drawings (wherein like numerals denote like parts).

DETAILED DESCRIPTION OF THE INVENTION

Figure 1:
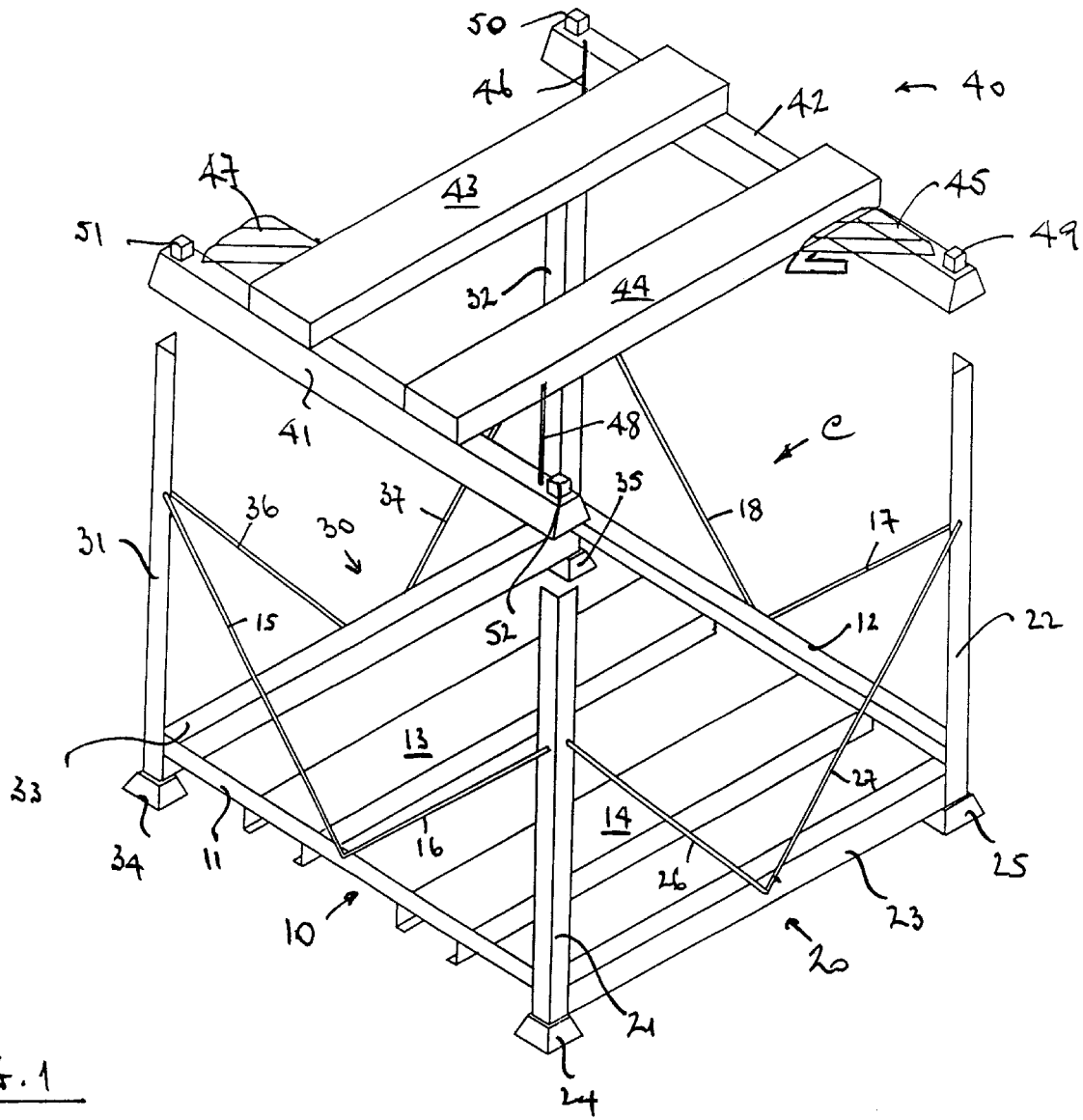
FIG. 1 a schematic perspective view of a frame in accordance with the present invention.

With reference to the drawings, it can be seen that a frame according to the present invention comprises a base-component 10, side-components 20 and 30 and a top-component 40.

The base-component 10 consists of two frame-members 11 and 12, which are maintained in parallel spaced-apart relationship by means of cross-members 13 and 14. Cross-members 13 and 14 are of generally rectangular hollow section and are adapted to receive the tines of a fork-lift truck, whereby the entire frame can be lifted.

The side-components 20 and 30 each consist of two frame-members 21, 22 and 31, 32 respectively. Each pair of frame-members is maintained in parallel spaced-apart relationship by means of respective cross-members 23 and 33. Each of the frame-members 21, 22, 31 and 32 is provided at its end adjacent the base-component with a foot 24, 25 and 34, 35 respectively.

The side-components 20 and 30 are so attached to the base-component 10 as to define a cavity C for the reception of a container (not shown). Further support-members ("stretchers") 15, 16, 17, 18; 26, 27; 36, 37 are provided to enhance the stability of the frame.

The top-component 40 consists of two generally U-section frame-members 41 and 42, which are maintained in parallel spaced-apart relationship by means of cross-members 43 and 44. Cross-members 43 and 44 are of generally rectangular hollow section and are adapted to receive the tines of a fork-lift truck, whereby the top-component can be lifted clear of the remainder of the frame.

Four hook-like support-members 45, 46, 47 and 48 are attached between the frame-members and the cross-members, one at each corner of the top-component 40.

Location lugs 49, 50, 51 and 52 are provided, one at each corner of the top-component 40, to receive the feet of a further frame to be stacked above the frame of FIG. 1.

Figure 2:
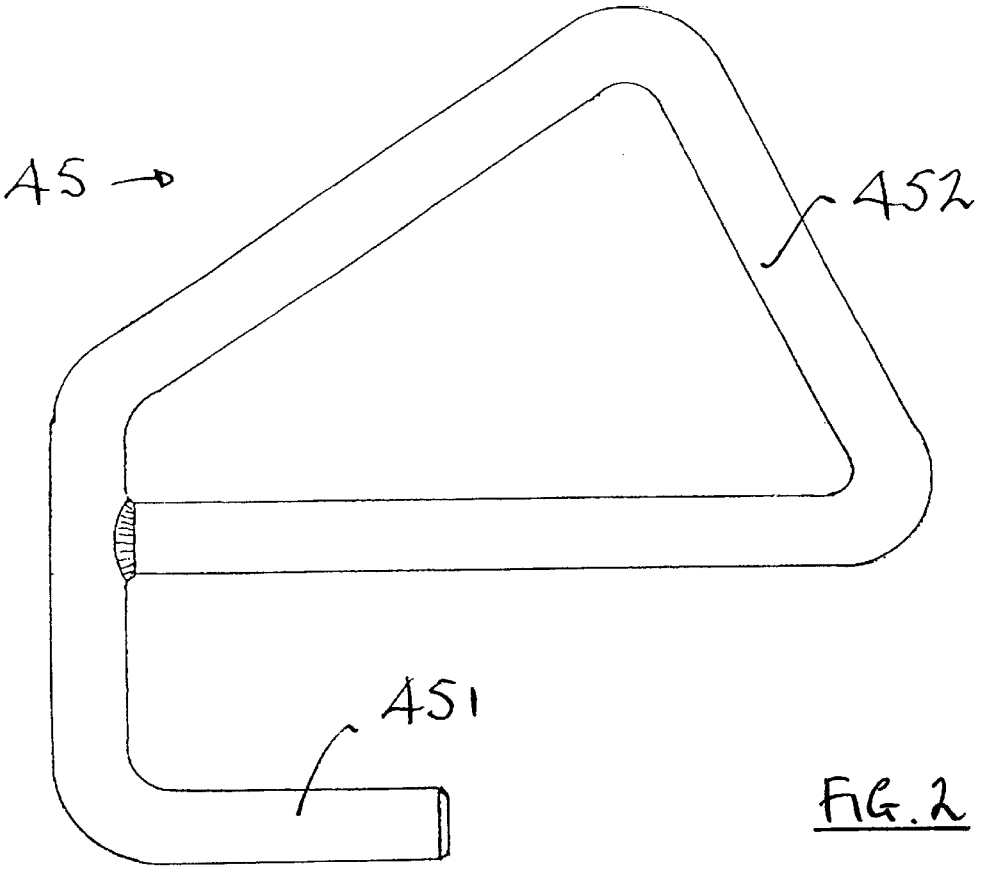
FIG. 2 is a view of a hook-like support member for use in connection with the frame of FIG. 1.

Referring now to FIG. 2, the support-member 45 comprises a hook portion 451 adapted to extend into the cavity C of FIG. 1, together with a generally triangular portion 452 adapted to engage the top-component 40 and to be supported thereon.

Figure 3:
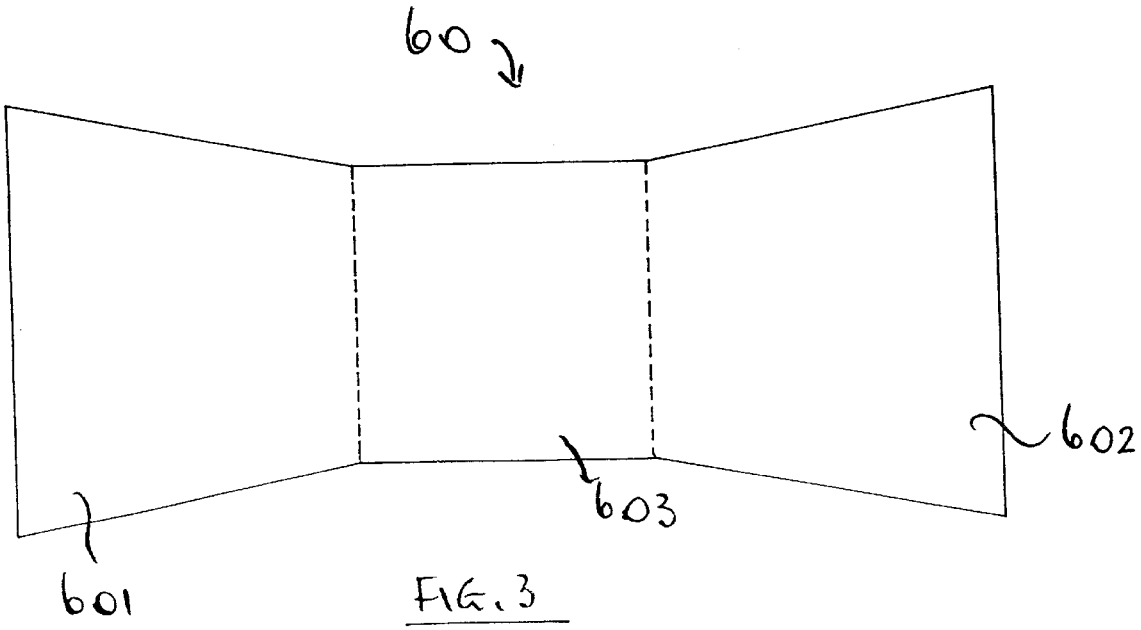
FIG. 3 is a view of a reinforcing-member or "butterfly" for use in connection with the frame of FIG. 1.

The reinforcing-member or "butterfly" 60 shown in FIG. 3 comprises two "wing" portions 601 and 602 which extend from opposite sides of the "base" portion 603. The "butterfly" is of generally U-shaped transverse section and is configured so as to correspond to and to be engaged with the U-shaped section of the frame-members 41 and 42.

What is claimed is:

1. A frame for supporting a substantially non-rigid container, said frame comprising:

(a) a base-component consisting essentially of at least two frame members maintained apart and substantially parallel to each other by at least two cross members;

(b) a pair of side-components adapted to be attached to opposite sides of said base-component (a) and to extend upwardly therefrom in a plane substantially perpendicular to the plane of said base-component (a), each of said side-components (b) consisting essentially of at lease two frame-members maintained apart and substantially parallel to each other by at least one cross-member;

(c) a top-component adapted to operatively engage said side-components (b) and to be substantially parallel to said base-component (a), whereby said base-component (a), said side-components (b) and said top-component (c) define between them a substantially parallelpiped cavity to receive said container, said top-component (c) consisting essentially of at least two frame-members maintained apart and substantially parallel to each other by at least two cross-members, together with at least one support-member to engage and support said container, said top-component (c) being adapted to be lifted free of said side-components (b); and wherein each of said at least two frame-members of said top-component (c) is of substantially U-shaped transverse cross-section whereby, when said top-component (c) and said side-component (b) are brought into operative engagement, each of said at least two frame-members of said side-component (b) is received within the "U" of a frame-member of said top-component (c).

2. The frame of claim 1, wherein said "U" in said substantially U-shaped section of said top component (c) comprises first and second arms interconnecting a base and each of said arms is at an obtuse integral angle to said base of said "U."

3. The frame of claim 2, wherein said angle is between about 104° and about 110°.

4. The frame of claim 1, wherein said at least two cross-members of said base-component (a) are substantially at right angles to said at least two frame-members of said base-component.

5. The frame of claim 4, wherein said at least two cross-members of said base-component are of hollow transverse section and adapted in use to receive lifting-means.

6. The frame of claim 1, wherein a foot or similar support is attached to a lowermost end of each of said at least two frame members of said side-component (b).

7. The frame of claim 1, wherein said at least two cross-members of said top-component (c) are substantially at right angles to said at least two frame-members of said top-component.

8. The frame of claim 7, wherein said at least two cross-members of said top-component are of hollow transverse section and adapted in use to receive lifting-means.

9. The frame of claim 1, wherein each of said at least two frame-members of said top-component (c) is provided with at least one reinforcing-member, each of said at least one reinforcing-members being received within and attached to the inner surfaces of said U-shaped section of each of said at least two frame-members.

10. The frame of claim 9, wherein one of said at least one reinforcing-members is located at each opposite end of said at least two frame-members of said top-component (c).

11. The frame of claim 1, wherein each of said at least one support-members which receives and engages said container on said top-component (c) comprises a hook-like member.

12. The frame of claim 11, wherein one of said hook-like members is provided at each corner of said top-component (c).

13. The frame of claim 11 wherein each said hook-like member has a substantially triangular portion adapted to engage one of said at least two frame-members of said top-component (c), whereby said triangular portion is supported on said top-component and said hook-like member extends therefrom into said cavity which receives said container.

14. The frame of claim 1, wherein said top-component (c) is provided with at least one location-member to engage and/or locate said side-components (b) of a second frame, whereby two or more frames can be stacked one above the other.

15. The frame of claim 14, wherein each of said at least one location-members engages a foot on one of said side-components (b).

* * * * *